United States Patent [19]

McStravick et al.

[11] 4,270,606

[45] Jun. 2, 1981

[54] APPARATUS FOR SELECTIVE DISENGAGEMENT OF A FLUID TRANSMISSION CONDUIT AND FOR CONTROL OF FLUID TRANSMISSION FROM A WELL ZONE

[75] Inventors: David M. McStravick, Houston; William M. Roberts, Deer Park, both of Tex.

[73] Assignee: Baker International Corporation, Orange, Calif.

[21] Appl. No.: 20,306

[22] Filed: Mar. 14, 1979

[51] Int. Cl.[3] ..... E21B 33/129; E21B 34/12

[52] U.S. Cl. ..... 166/181; 166/124; 166/133; 166/331; 166/315

[58] Field of Search ..... 166/315, 330, 331, 332, 166/334, 124, 131, 133, 181

[56] References Cited

U.S. PATENT DOCUMENTS

| | | | |
|---|---|---|---|
| 3,152,643 | 10/1965 | Burns | 166/124 |
| 3,189,316 | 6/1965 | Preston, Jr. | 166/332 X |
| 3,332,495 | 7/1967 | Young | 166/331 X |
| 3,347,318 | 10/1967 | Barrington | 166/331 |
| 3,382,927 | 5/1968 | Davis, Jr. | 166/124 |
| 3,398,928 | 8/1968 | Fredd | 166/330 X |
| 3,442,328 | 5/1969 | Nutter | 166/331 X |

*Primary Examiner*—Stephen J. Novosad
*Attorney, Agent, or Firm*—William C. Norvell, Jr.

[57] ABSTRACT

An apparatus is provided for the selective disengagement of a fluid transmission conduit which is insertable through a second conduit for communication to a zone within a well bore, and for control of fluid transmission from the zone upon disengagement of the fluid transmission conduit. The apparatus defines a sealing means, usually a packer assembly, which communicates with the interior of the fluid transmission conduit for isolating an annular area between the fluid transmission conduit and the second conduit and above the zone. Valve means carried by the fluid transmission conduit and communicating with the sealing means is manipulatable between open and closed positions for selective isolation of fluid flow through the sealing means to the fluid transmission conduit. Conduit disengaging means are defined above the valve means for communication with and carriage by the fluid transmission conduit, the conduit disengaging means being responsive to manipulation of the fluid transmission conduit after manipulation of the valve means to closed position for disengagement of the fluid transmission conduit.

50 Claims, 16 Drawing Figures

APPARATUS FOR SELECTIVE DISENGAGEMENT OF A FLUID TRANSMISSION CONDUIT AND FOR CONTROL OF FLUID TRANSMISSION FROM A WELL ZONE

BACKGROUND OF THE INVENTION

1. Field of the Invention

The invention relates to a method and apparatus for isolating a production zone in a subterranean well when tubing is retrieved therefrom without killing the well or encountering liquid backflow through the tubing as it is retrieved.

2. Description of the Prior Art

In order to recover oil in production zones after economical primary production operations have terminated, produced salt water from other zones or reservoirs is injected into the production zone by means of injection wells to cause migration of the remaining oil to the producing well. This water may be expected to have a high solids content and, often, because of exposure to air at the well surface, the water also will contain dissolved oxygen, the combined features of dissolved oxygen in the water and salt water being utilized as the liquid injection medium defining a highly corrosive environment for the tubing.

In order to recover the remaining oil in the production zone at an economical rate, the flow rate is increased by maintaining a high water injection pressure which also may ultimately increase the initial and normal pressure of the production zone in the vicinity of the injection well bore.

Because of the high pressure and high corrosive environment, it is desirable to run tubing within the casing, the tubing carrying a packer apparatus for sealing engagement along the I.D. of the casing within the tubing-casing annulus above the injection zone to completely isolate the annular area thereabove from the injection fluids. The packer apparatus normally is designed to selectively latch and sealingly receive the bottom exterior end of the tubing string, so that it may be removed from the packer apparatus, leaving the packer apparatus sealingly intact.

Oftentimes, because of the increased production zone pressure, the injected fluid will backflow through the upper end of the tubing at the top of the well as it is being retrieved. If precautions are not taken, the backflow will result in the need for auxiliary disposal means and procedures to avoid potential environmental damage in the vicinity of the well site. Lack of precautions also may result in loss of oil production through the production well, since the injected salt water fluid is reversed by the backflow, thus reducing the migration of the production toward the production well.

Typically, backflow problems have been avoided by seating of a wire line blanking plug into the bore of an on-off sealing connector, the plug preventing flow of fluid in either direction so that the tubing string may be pulled out of the well bore and rerun without backflow of the injected salt water. Such a procedure is not entirely satisfactory because it may be assumed that the tubing string has suffered considerable chemical deterioration resulting from oxygen corrosion and scale deposits, such that the time consuming and costly running and sealing engagement of a plug by wire line cannot be reliably accomplished. Alternatively, a weighted fluid may be injected into and circulated through the tubing-casing annulus into the well bore above the packer to balance the reservoir pressure and thus prevent a salt water backflow. This procedure is quite costly, is time consuming, and can lead to additional problems when the weighted fluid is removed from the well, i.e., problems encoutered in preventing inadvertent injection of the weighted fluid into the formation.

Similar problems and solutions as those set forth above are found in salt water disposal operations. Additionally, the need to retrieve tubing strings is encountered in artificial lift wells in which gas lift mandrels must be relocated. If the well is capable of flowing at a reduced rate without artificial lift applications, a means for isolating the flow of fluid through the tubing string must be utilized.

In all of the above circumstances, a safety device is necessary to prevent any fluid flow due to unforeseen circumstances while the tubing is being retrieved and subsequent thereto.

The present invention obviates the problem set forth above by providing a method and apparatus for selectively retrieving a tubing string, the lower opened end of which is sealingly insertable through the bore of a packer which, in turn, is sealingly engaged onto the inner wall of the casing above an injection or other zone, the tubing retrieval being accomplished with mechanical valve means being provided to isolate the well flow therethrough and prevent backflow of the injection medium.

SUMMARY OF THE INVENTION

The present invention provides an apparatus which permits selective disengagement of a fluid transmission conduit within a well. The apparatus comprises a sealing means, which may be a conventional permanent or retrievable packer, which communicates with the interior of the fluid transmission conduit for isolating the annulus defined between the conduit and the well casing above a production zone. Valve means are provided which communicate with the fluid transmission conduit and the packer assembly and which is responsive to rotational or other manipulation of the fluid transmission conduit to shift the valve between open and closed positions for selective isolation of fluid flow through the sealing means to the fluid transmission conduit. A conduit disengaging apparatus is defined above the valve means for communication with and carriage by the fluid transmission conduit, the conduit disengaging means being responsive to rotation or other manipulation of the fluid transmission conduit subsequent to initial shifting of the valve means to a closed position, for disengagement of the fluid transmission conduit and isolation of fluid flow through the sealing means from the production, injection or other zone or area to the top of the well.

DESCRIPTION OF THE PREFERRED EMBODIMENTS

Figure 1:
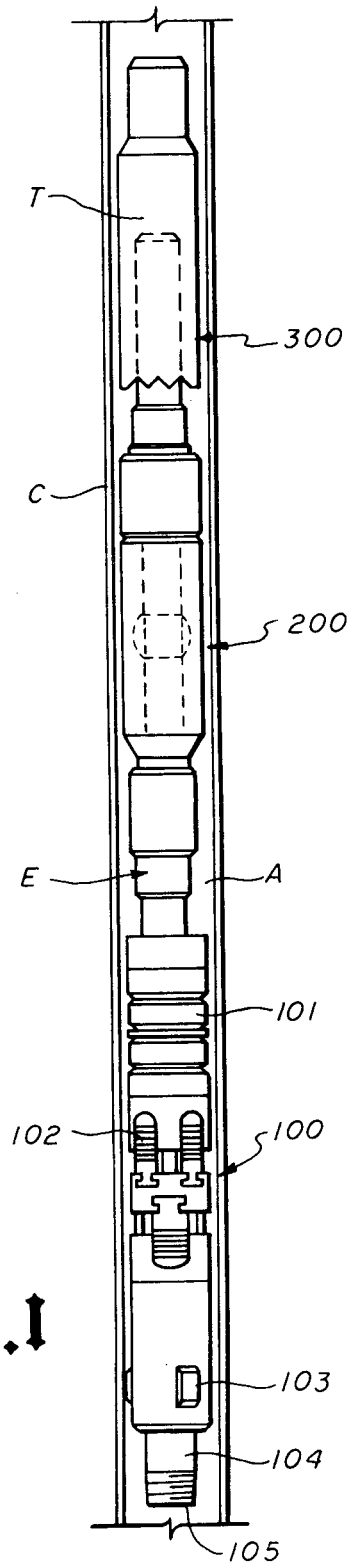
FIG. 1 is a longitudinal schematic illustration showing the apparatus of the present invention inserted within the casing of a well bore above a subterranean zone, the view being taken prior to the setting of the sealing or packer apparatus.

Referring now to FIG. 1, there is shown within the interior of casing C (or, the second conduit) a tubing connector 300 carried at the lower end of a fluid transmission conduit T, with a vlave apparatus 200 affixed and carried at the lower end of the tubing connector 300. A tubing extension E at the lower end of the valve apparatus 200 connects to a packer assembly 100 therebelow. The packer assembly 100 comprises a circumferentially extending elastomeric seal assembly 101 of conventional nature at its upper end defining an annulus A between the packer assembly 100 and the casing C. When the packer assembly 100 is set, the seal assembly 101 sealingly engages along the internal diameter of the casing C to prevent fluid migration across the seal assembly 101. The packer assembly 100 also comprises on its outer body a conventional slip assembly 102 for anchoring engagement on the wall of the casing C to prevent upper and lower movement of the packer assembly 100. A conventional guide 103 at the lowermost portion of the packer assembly guides the assembly 100 within the casing C. A packer extension or other tubular means which may have threads 104 for connection to tools or component parts therebelow is defined at the lower end of the packer assembly 100. Alternatiely, the packer extension may simply have defined thereon a port 105 for communication to and ejection of salt water solution, into a zone therebelow.

The packer assembly 100 is of conventional design, and may be constructed for permanent set within the well, or may be selectively retrievable. In any event, numerous packer assemblies well known to those skilled in the art may be utilized in combination in the present invention, and the particular and selected packer assembly for utilization herein is not necessarily critical to the invention. The packer assembly selected for use in the invention should be one which defines seal means thereon for prevention of migration of fluid between the annulus A and the injection zone.

If the packer assembly 100 is of the retrievable design, it should be one that is set to the right and does not allow rotation to the left and does not allow rotation in the direction required to manipulate the valve assembly 200 to the closed position. In other words, the selected retrievable packer should set in the opposite direction as that required for rotation of the valve assembly 200 from the open to the closed position.

Figure 3:
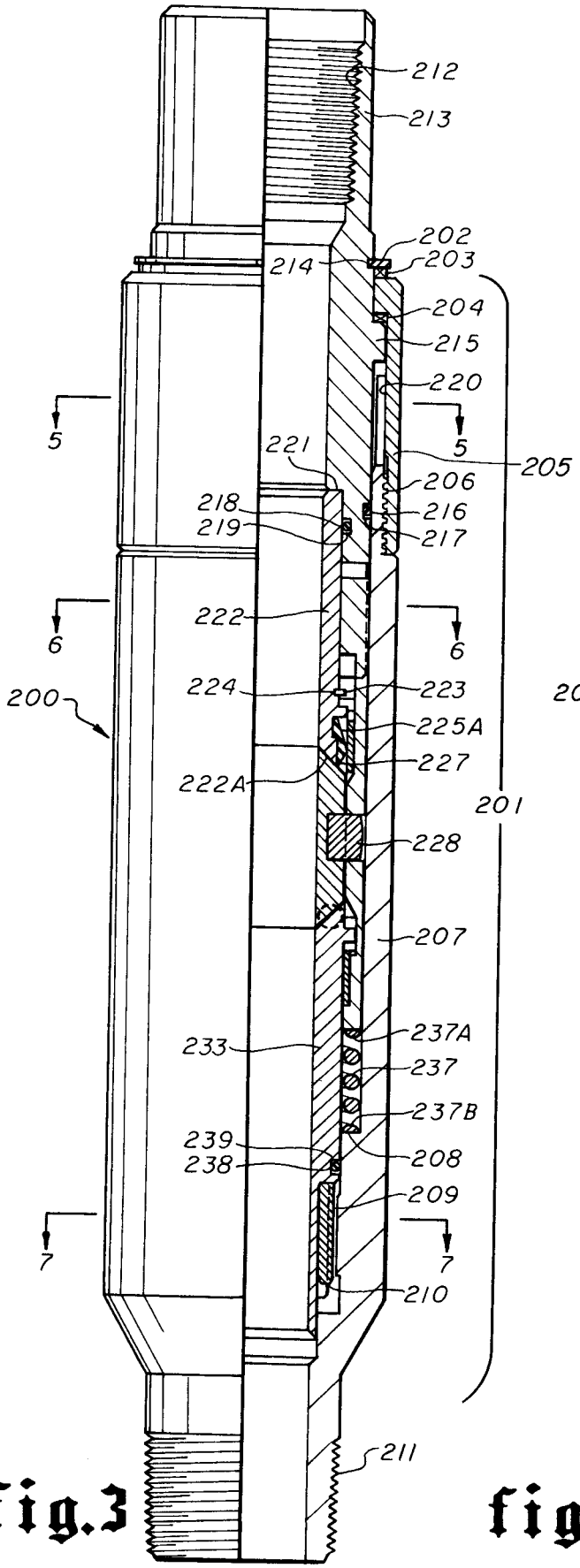
FIG. 3 is an enlarged sectional view of the valve apparatus of the present invention in open position.
Figure 4:
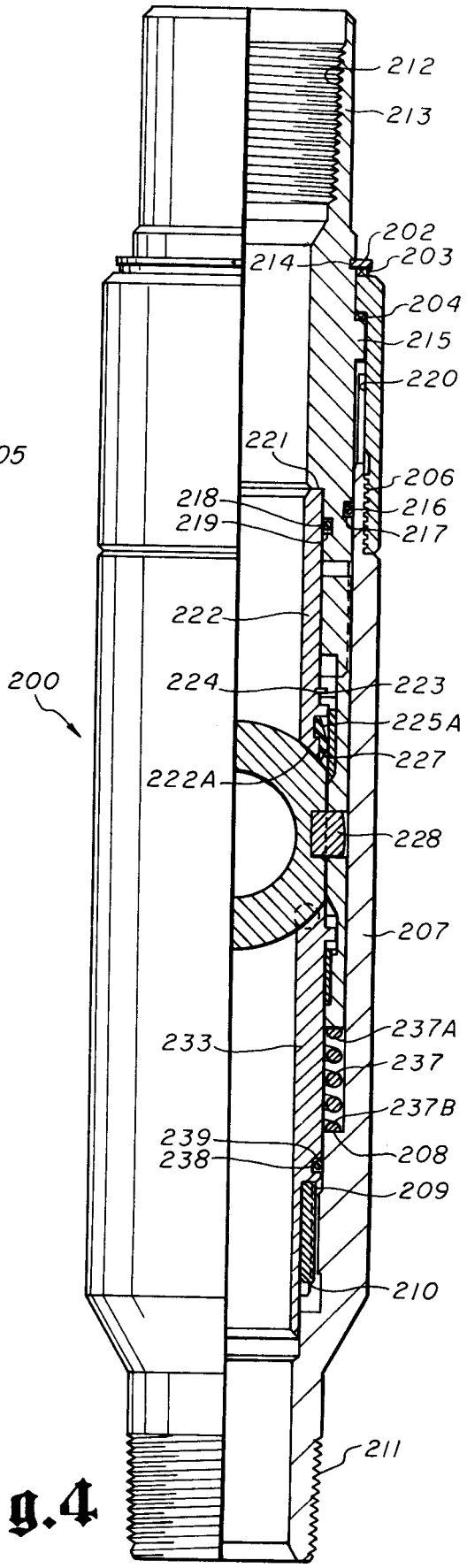
FIG. 4 is a view similar to that shown in FIG. 3, but illustrating the valve apparatus subsequent to shifting to the closed position.

Now, referring to FIGS. 3 and 4, a valve apparatus 200 is illustrated with threads 212 at its uppermost end for affixation to the lower end of the tubing connector 300. The valve apparatus 200 has an outer housing 201 which generally consists of a bearing retainer 205 at its uppermost end which is connected by threads 206 to a lower housing 207 therebelow.

Above the bearing retainer 205 are upper and lower bearing assemblies 203 and 204, respectively, the upper bearing assembly 203 being supported in position by a circumferentially extending arc ring 202 held in place upon a top sub member 213 and within a grooveway 214. The bearings 203 and 204 may be teflon-fabricated coated elements which permit rotation of the top sub 213 relative to the outer housing 201 without excessive friction.

Figure 7:
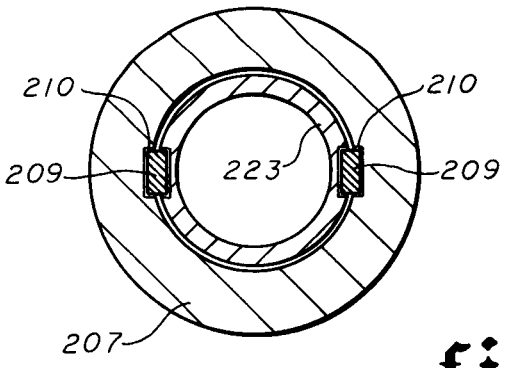
FIG. 7 is a cross-sectional view taken along Lines 7—7 of FIG. 3.

The lower housing 207 has defined inwardly thereon a shoulder 208 for receipt of the lower end 237B of a helical compression spring 237. Also at the lower portion of the lower housing 207 and as particularly depicted in FIG. 7, are a pair of keys 209 interengaged between the lower housing 207 and the follow sleeve 233. Each key 209 is lodged within a recess 210 spaced 180° apart from one another. This key and recess system 209-210 permits locking interengagement between the follow sleeve 233 and the lower housing 207 and thereby prevents rotational movement therebetween during manipulation of the ball element 226.

At the lowermost end of the lower housing 207 is a series of threads 211 for connection of the valve apparatus 200 to an extension E or, alternatively, to the uppermost end of the packer assembly 100.

Interior of the outer housing 201 is a top sub 213 having the threads 212 defined thereon at its uppermost end and the grooveway 214 defined circumferentially around the exterior of the uppermost end of the top sub 213 for receipt of the inner portion of the arc ring 202. An extension shoulder 215 also is defined on the top sub 213 for transmission of tensil forces through the apparatus 200. A circumferentially extending elastomeric O-ring seal element 216 is defined circumferentially within a grooveway 217 therefor on the top sub 213 to prevent fluid communication between the top sub 213 and the lower housing 207. Similarly, a ring 218 within a companion groove 219 also is defined on the top sub 213 to prevent fluid communication between the top sub 213 and a ball seat sleeve 222 carried therebelow.

Figure 5:
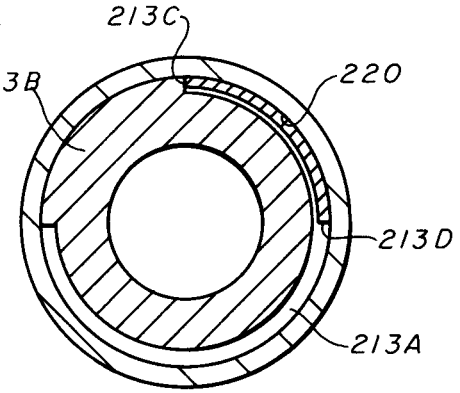
FIG. 5 is a cross-sectional view taken along Lines 5—5 of FIG. 3.

Now referring to FIG. 5, a rotation lock 220 is carried by the lower housing 207 and within a slot 213A defined between the retainer 205 and the top sub 213 to permit lefthand rotation of the top sub 213 and the ball seat sleeve 222 to rotate the ball 226 from open to closed position prior to clutch engagement between the top sub 213 and the lower housing 207 to transmit the rotational force from the tubing through the top sub 213 to the outer housing 201 to, for example, retrieve the well packer assembly 100 therebelow. The rotation lock 220 illustrated in FIG. 5 is a portion of a clutch assembly which has an arresting stop element 213B defined as a portion of the top sub 213, the rotation lock 220 having first and second stop ends 213C and 213D for checking the rotational travel of the top sub 213 and for selective carriage of the outer housing 201 rotatably therewith.

The top sub 213 also defines an inwardly extending lowerly facing shoulder element 221 for interface with the upper end of a longitudinally extending cylindrical ball seat sleeve 222 therebelow.

Figure 8:
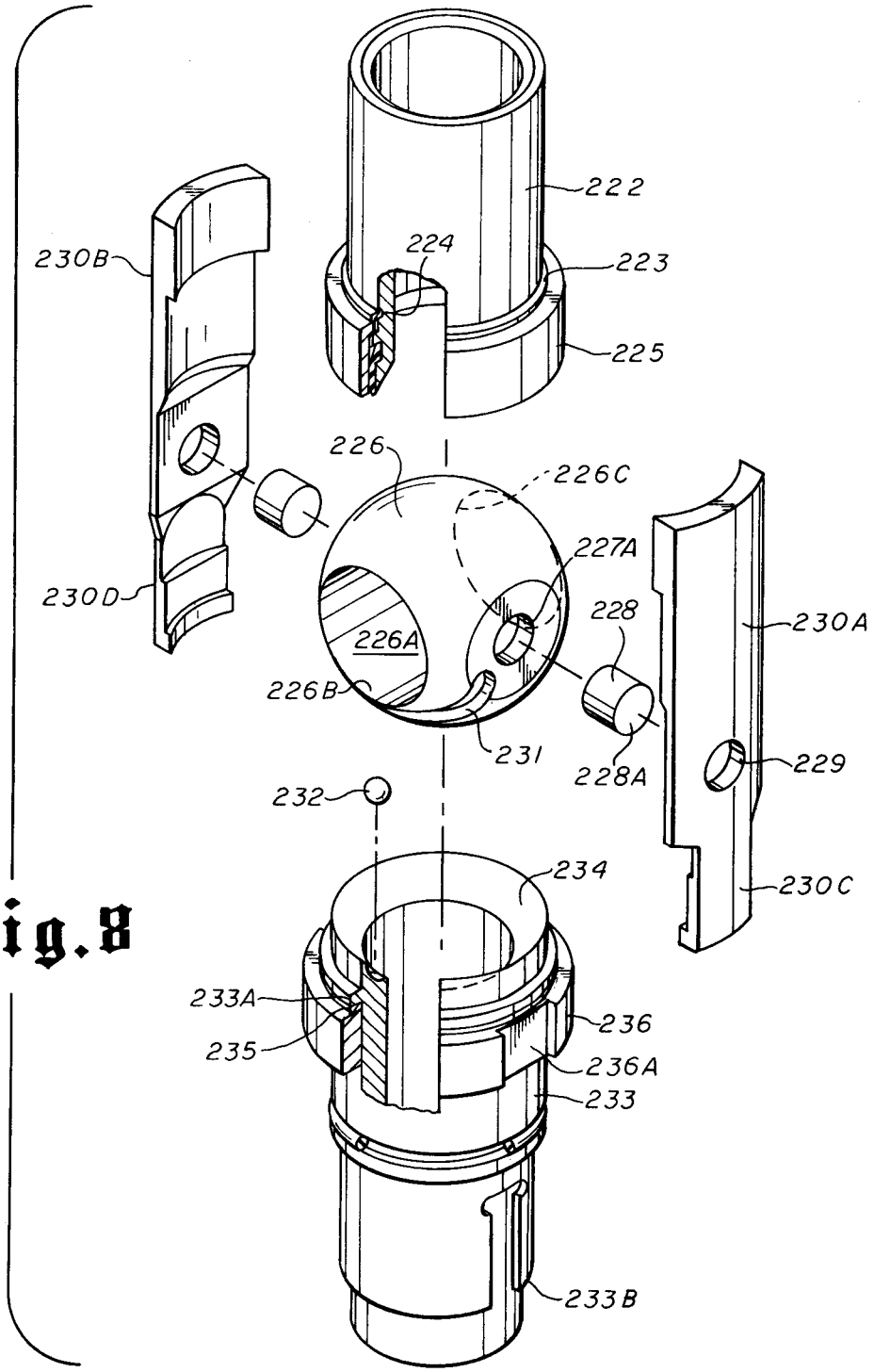
FIG. 8 is a dimensionalized illustration of the component parts of the ball valve, ball seat and ball cage arms, as shown in FIGS. 3, 4, 9, 11 and 13.

Now referring to FIG. 8, the ball seat sleeve 222 has defined thereon an exteriorly facing groove 224 for engagement of a ring 223 carried therearound, the ring 223 securing a resilient seal retainer 225 housed interiorly at the lowermost end of the ball seat sleeve 222, the retainer 225 providing a portion of a housing for a resilient seal 225A (FIG. 3), made of an elastomeric material, the smooth lower end or face 227 of the seal 225A sliding along the outer peripheral surface of the ball 226 during pivotal rotation.

With continued reference to FIG. 8, a spherical ball element 226 has a central passageway 226A therethrough, the passageway 226A terminating at each end of the ball 226 by open end 226B and open end 226C, the passageway 226A communicating with the upper and lower interior of the valve assembly 200 for selective transmission of the salt water injection or other fluid. The ball 226 has transversely defined immediate the passageway 226A circular trunion sockets 227A, each socket 227A being defined 180° relative one to another across the outer face of the ball 226, each trunion socket receiving a trunion pin 228 having its end 228A received within a trunion hole 229 defined within elevated first and second cage arms 230A and 230B, respectively.

The ball 226 also has defined exteriorly thereon a camway 231 for relative travel of a camway ball 232 which is slidably manipulatable thereon. The camway 231 is machined on the periphery of the ball 226 in a plane cutting through the axis of the pins 228 and at a 45° angle to the open ends 226B and 226C defining the ends of the passageway 226A through the ball 226. The camway 231 extends on one end to at least the plane of a diameter cut through the center of the ball 226 at right angles to the trunion pins 228, and on the other end to a point such that a line through this point to the center of the ball 226 would make an angle somewhat less than 45° with the axis of the trunion pins. The cosine of the angle of rotation of the ball seal sleeve 222 is equal to the tangent of an angle equal to 45° minus the angle of the rotation of the ball 226.

Figure 13:
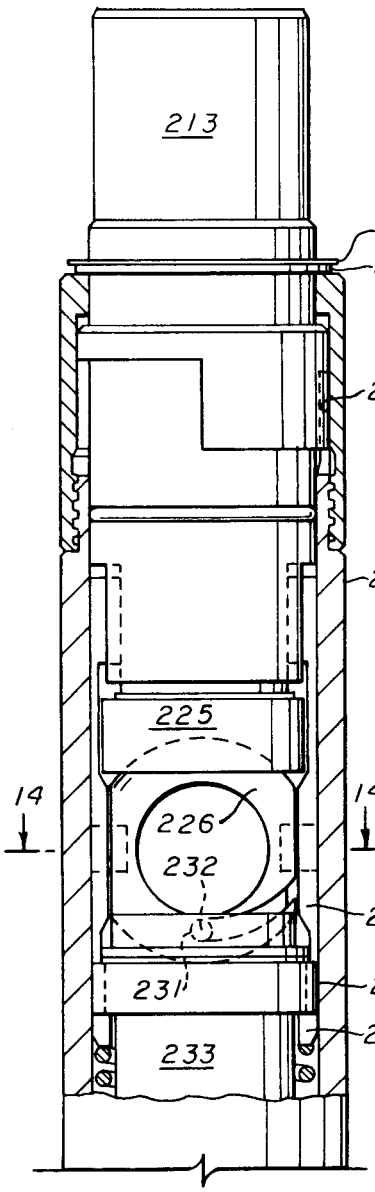
FIG. 13 is an enlarged sectional elongate view of the valve apparatus of the present invention illustrating the valve when the ball member is shifted to the closed position.
Figure 11:
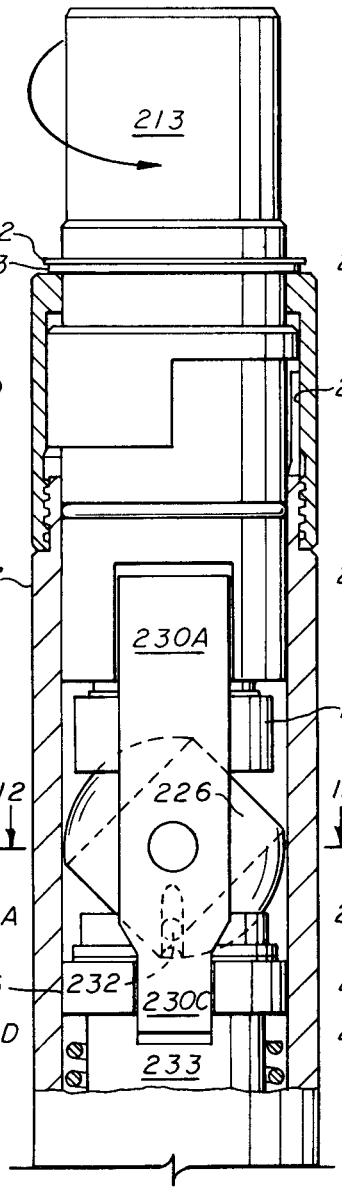
FIG. 11 is an enlarged sectionalized illustration of the valve apparatus of the present invention shifting from the open position shown in FIG. 9 to the closed position shown in FIG. 13.
Figure 9:
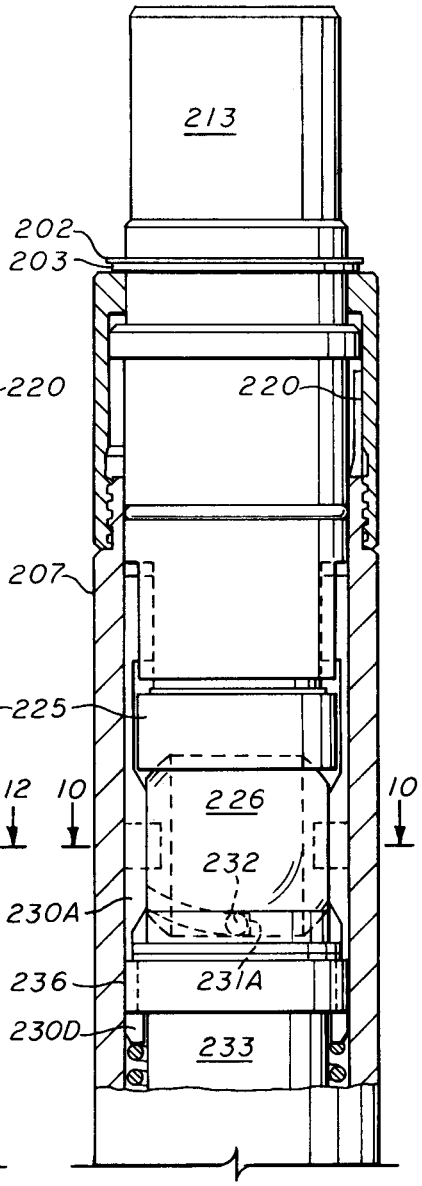
FIG. 9 is an enlarged view of the valve apparatus of the present invention with the ball illustrated in open position.
Figure 14:
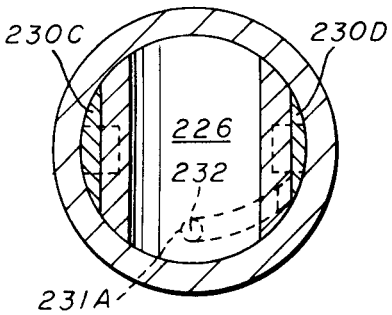
FIG. 14 is a cross-sectional view taken along Lines 14—14 of FIG. 13.
Figure 12:
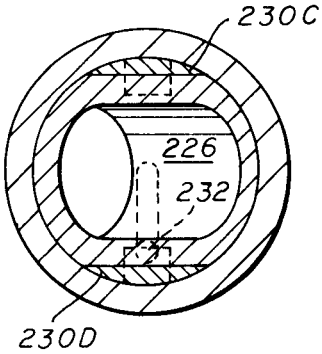
FIG. 12 is a cross-sectional view taken along Lines 12—12 of FIG. 11.
Figure 10:
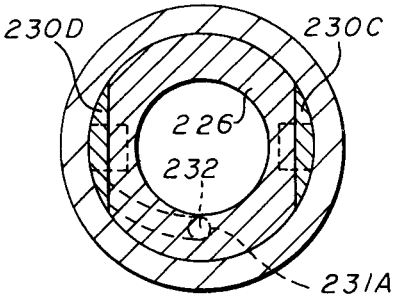
FIG. 10 is a cross-sectional view taken along Lines 10—10 of FIG. 9.
Figure 15:
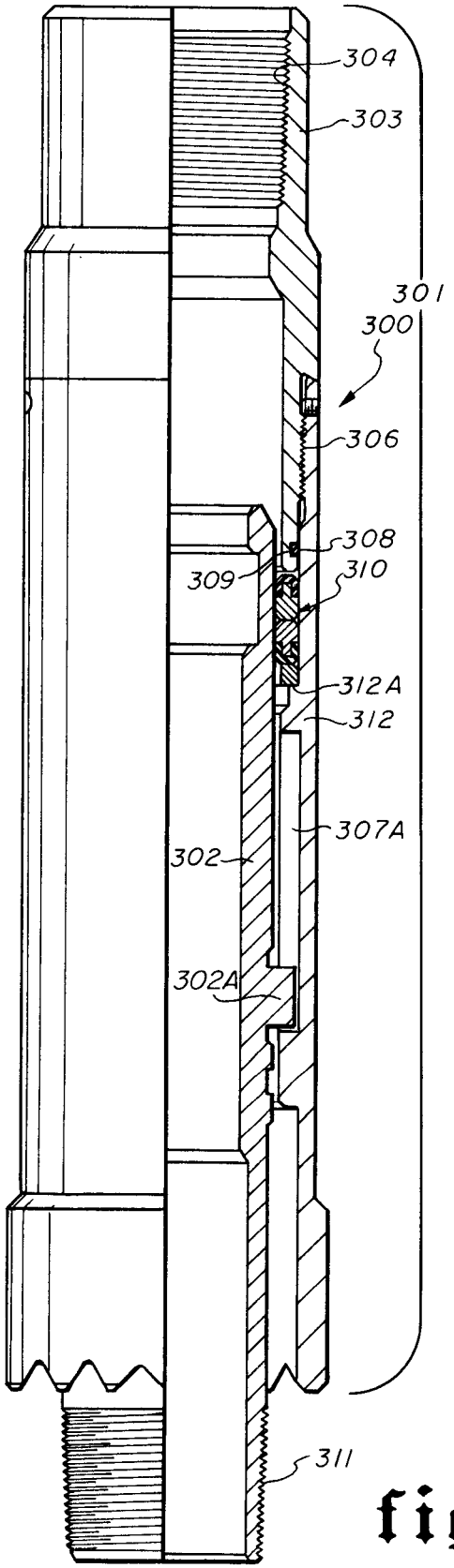
FIG. 15 is an elongated partial cross-sectional view of the tubing connector of the present invention in initial position as schematically depicted in FIG. 1.

In the position shown as in FIGS. 9 and 13, the distance from the center of the camway ball 232 to a plane passing through the trunion pins 228 and a center line of the valve assembly 200 is a maximum and is equal to the vertical distance from the center line of the trunion pins 228 to the camway ball 232. Now when the ball seal sleeve 222 is rotated 90°, the above mentioned vertical distance remains constant, but the distance to the center line decreases to zero. This configuration is shown in FIG. 11. It can be seen that the only time a point on the camway 231 can also have a zero distance from the center line is when the plane of the camway 231 coincides with the plane through the trunion 228 and the center line of the valve assembly 200. In other words, when the ball seal sleeve 222 is rotated 90°, the ball 226 pivotally rotates 45° and would be half open, as is illustrated in the position shown in FIG. 11. To fully open the ball 226 or turn it 90°, the ball seal sleeve must be rotated 180°.

Figure 6:
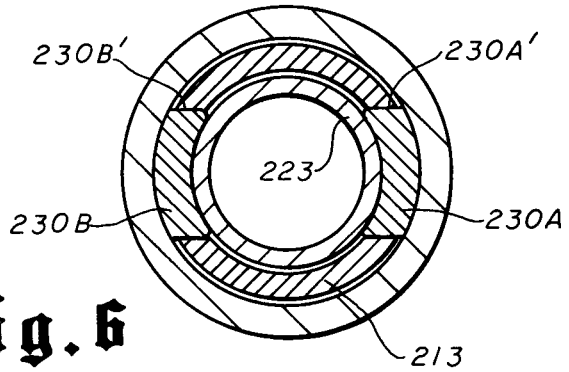
FIG. 6 is a cross-sectional view taken along Lines 6—6 of FIG. 3.

The upper end of each cage arm 230A and 230B are received between cage arm receiving slots 230A' and 230B' defined on the lower periphery of the top sub 213 to enable rotational movement through the top sub 213 to the arms 230A and 230B to rotate the ball 226, as shown in FIG. 6.

In FIG. 8, the cage arms 230A and 230B have defined below the hole 229 at the lowermost end thereof an arms sleeve section 230C and 230D, respectively, which is secured within the respective slips 236A defined within the follow sleeve 233, each slip 236A being 180° apart and defined within a cage support ring 236 carried exteriorly of the follow sleeve 233. A cage bearing 235 is carried above the support ring 236 and below an extending outward shoulder 233A on the follow sleeve 233, the cage bearing 235 permitting rotation between the cage arms 230A, 230B and the cage support ring 236, and the follow sleeve 233. The lower end 233B of the follow sleeve 233 has an elastomeric O-ring seal element 238 carried within a circumferentially extending exterior grooveway 239 thereon to prevent fluid communication between the follow sleeve 233 and the lower housing 207.

At the uppermost end of the follow sleeve 233 is a beveled metallic ball seat 234 for interface around the outer periphery of the ball 226 as the ball 226 is pivoted and rotated with respect to the follow sleeve 233 during manipulation between opened and closed positions. The ball seat 234 also houses in affixed relation to the follow sleeve 233 a camway ball or bearing 232 which is snuggly engaged for travel within and along the camway 231 of the ball 226. Preferably, the camway ball 232 is made of a hard material, such as tungsten carbide or hardened steel.

As shown in FIG. 9, the camway 231 has a terminal 231A which interfaces with the camway ball 232 when the ball 226 is in the fully open position and acts as a stop against further rotation. The terminal 231A interfaces with the camway ball 232 when the ball 226 is pivotally rotated to the completely closed and open positions, the interface of the terminal 231A and the camway ball 232 preventing further rotational pivoting of the ball 226.

As shown in FIGS. 3 and 4, a spring 237 is housed between the follow sleeve 233 and the lower housing 207 with the upper end 237A of the spring 237 urging against the cage arms 230, and the lower end 237B of the spring 237 resting against a shoulder 208 on the lower housing 207. The spring 237 causes the ball 226 to engage the resilient seal 225A.

It should be noted that when the fluid transmission conduit T is rotated, the top sub 213 will rotate correspondingly and will, in turn, rotationally carry the cage arms 230A and 230B which, in turn, permit the trunion pins 228 to rotate the ball 226, the cage arms 230A and 230B being supported by the top sub 213 thereabove and therebelow by means of the cage support ring 236. As the cage arms 230A and 230B rotate the respective trunion pins 228 to rotate the ball 226, the relative travel of the camway ball 232 within the camway 231 causes the ball 226 also to pivot, thus pivotably rotating the ball 226 between open and closed positions, the follow sleeve 233 remaining in stabilized position relative to the travel of the cage arms 230A and 230B.

Now referring to FIGS. 1, 2, 15 and 16, the tubing connector 300 is affixed by means of threads 304 to the lower end of the fluid transmission conduit T. The tubing connector 300 generally is comprised of two component parts: the outer housing 301, comprised of the top sub 303 and a longitudinally extending washover shoe 312; and an inner mandrel 302 housed interiorly of the washover shoe 312.

The top sub 303 is affixed to the washover shoe 312 by means of threads 306, a set screw 305 being secured through the washover shoe 312 and into the top sub 303 to provide additional securement. An elastomeric ring 308 is circumferentially defined within a companion groove 309 on the top sub 303 to prevent fluid communication between the top sub 303 and the washover shoe 312. Upper and lower seal elements define a seal assembly 310 which is housed in an annular area between the uppermost end of the inner mandrel 302 and the washover shoe 312, a beveled shoulder 312A defined interiorly around the washover shoe 312 encapsulating the seal assembly 310 and preventing its lower movement, while the lowermost end of the top sub 303 encircles the uppermost end of the seal assembly 310 to prevent upward travel of the seal assembly 310. The seal assembly 310 prevents fluid communication between the inner mandrel 302 and the washover shoe 312.

Figure 16:
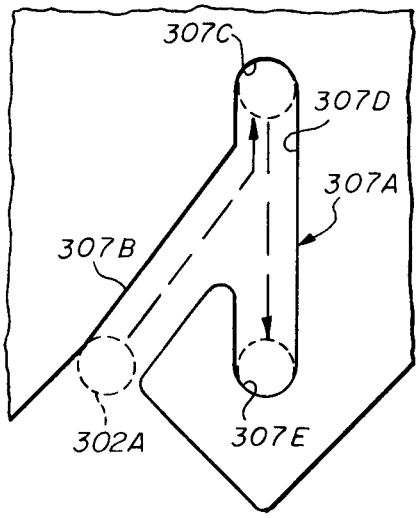
FIG. 16 is a view of the slot and pin assembly as utilized in the connector illustrated in FIG. 15.

Now referring to FIG. 16, a slot assembly 307A is defined around the interior of the washover shoe for receipt of a slot pin 310 defined on the inner mandrel 302. The apparatus is run in the hole and set in a manner known to the art. Then, the conduit T is picked up such that the pin 302A travels from the upper slot 307C through the main carriage 307D to position in the lower slot 307E. Now, the slip assembly 102 is engaged along the inner wall of the casing C and the seal assembly 101 is sealingly engaged on the casing C.

The inner mandrel 302, which carries the outwardly protruding slot pin 302A, terminates at its lower end by means of threads 311 which serve to affix the inner mandrel 302 to a tubular extension, or, alternatively, to the top sub 213 of the valve apparatus 200.

OPERATION

Figure 2:
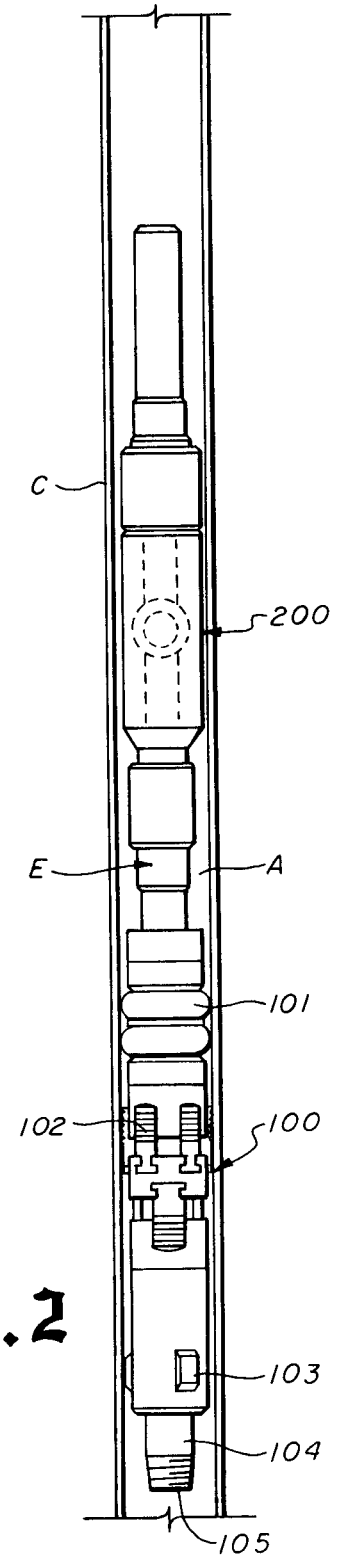
FIG. 2 is a schematic illustration similar to that as shown in FIG. 1, the view illustrating the component parts of the apparatus in position in the well after retrieval of the fluid transmission conduit from the connector assembly of the apparatus.

Referring now to FIGS. 1 and 2, the apparatus of the present invention is made up at the bottom of the fluid transmission conduit T with the tubing connector 300 affixed to the lowermost end of the conduit T, the valve apparatus 200 being affixed for communication to the lower end of the tubing connector 300, an extension E being affixed to the lower end of the valve apparatus 200 and insertable through or affixed to the upper end of a packer assembly 100. The apparatus is run into the well within the casing C to the desired depth. When it is desired to set the packer assembly 100 for isolation of the annulus A above the packer assembly 100 with the injection or other zone therebelow, the conduit T may be rotated or manipulated to set the packer as is well known in the art. Subsequently, the conduit T is picked up such that the pin 302A travels along the main carriage 307D until it is received within the lower slot 307E. At this time, the slip assembly 102 has expanded into anchored relationship with the casing C and the seal assembly 101 has become sealingly engaged along the I.D. of the casing C. Thereafter, the injection or other fluid is transmitted through the conduit T, the tubing connector 300, the valve apparatus 200, the extension E, and the seal assembly 101, thence through the port 105 for injection into the production zone therebelow (not shown). The position of the apparatus now is as illustrated in FIG. 2.

When it is desired to remove the conduit T from the well bore, the ball 226 of the valve apparatus 200 is first caused to be manipulated from the open to the closed position. First, set down weight is applied through the conduit T, typically on the order of from between about 5,000 to about 10,000 pounds, and the conduit T is rotated to the left. As set down weight is applied through the conduit T, the pin 302A of the tubing connector 300 is caused to be shifted within the slot 307A from the lower slot 307E through the main carriage 307D to the upper slot 307C. Then, the conduit T is rotated to cause a 180° rotation at the valve apparatus 200. Now referring to FIGS. 8 through 14, as the conduit T is rotated to the left, such lefthand rotation is carried through the valve apparatus 200 through the top sub 213 and to the ball seal sleeve 222 interconnected therewith. However, the outer housing 201 will not be caused to rotate because of the free play afforded by the bearings 203 and 204 in conjunction with the positioning of the rotation lock 220 around the slot 213A. The outer housing 201 will not rotate until such time as the arresting stop 213B moves from the stop end 213C to the stop end 213D. It should be noted that the travel distance between the end 213C of the rotation lock 220 and the end 213D of the rotation lock 220 is sufficient to permit the arresting stop 213B and the top sub 213, together with the ball seat sleeve 222, to travel 180°.

As the top sub 213 is rotated to the left, each of the cage arms 230A and 230B are also caused to travel therewith and to rotate the ball 226. Such lefthand rotation of the ball 226, in conjunction with the positioning of the camway ball 232 within the camway 231, permits the ball 226 to rotationally pivot until such time as the camway ball 232 moves relatively away from the terminal 231A, and thereafter returns toward terminal 231A, thereby isolating the passageway 226A within the ball 226 from the interior of the valve apparatus 200 above and below the ball 226. This position is as shown in FIG. 13.

It should be noted that as the cage arms 230A and 230B are rotated to the left, the cage arm support ring 236 is permitted to rotate 180° therewith by means of the cage bearing 235, but the follow sleeve 233 remains stationary because of its splined interconnection with the lower housing 207.

During manipulation of the ball 226 from the open to the closed position, the resilient seal 225A always travels across the smooth outer surface of the ball 226 and the open end 226C.

After the conduit T has been rotated sufficiently at the surface of the well to cause a 180° turn at the valve apparatus 200, the conduit T is tested at the surface of the well by opening surface valves. If pressure is successfully bled off and out of the conduit T, one is assured that the ball 226 has been manipulated from the open position shown in FIGS. 3 and 9 to the closed position shown in FIGS. 4 and 13.

Now, with the ball 226 being manipulated to the closed position, the lower end of the conduit T may be safely disengaged from the tubing connector 300. Continued lefthand torque is applied to the conduit T in combination with a slight pickup of the tubing to cause the pin 302A to travel from within the upper slot 307C along the wall 307B, thence out of the lower end of the slot 307A. When this is accomplished, the outer housing 301 is completely free of the inner mandrel 302 and may be retrieved with the lower end of the conduit T. The inner mandrel 302 will remain in the well bore affixed to the remaining component parts of the apparatus.

The tubing may be later engaged onto the top of the tubing connector 300 and the valve apparatus 200 may be manipulated from closed to open position by reversing the steps set forth above.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for the selective disengagement of a fluid transmission conduit insertable through a second conduit for communication to a zone within a well bore, and for control of fluid transmission from said zone upon disengagement of said fluid transmission conduit, comprising: sealing means having a flow passageway communicating with the interior of said fluid transmission conduit and for isolating an annular area between said fluid transmission conduit and said second conduit and above said zone; valve means having a flow passageway communicating with said fluid transmission conduit and with the passageway of said sealing means, said valve means being responsive to rotation of said fluid transmission conduit to manipulate said valve means between open and closed positions to selectively isolate fluid flow through the passageway of said sealing means to said fluid transmission conduit; and conduit disengaging means above said valve means and having a flow passageway communicating with and carriable by said fluid transmission conduit, said conduit disengaging means being responsive to rotation of said fluid transmission conduit after manipulation of said valve means to closed position to disengage said fluid transmission conduit, said sealing means being set within said annular area in response to rotation of said fluid transmission conduit in a first direction, and said valve means being manipulatable from open position to closed position in response to rotation of said fluid transmission conduit in a second direction.

2. The apparatus of claim 1; and said fluid transmission conduit is rotated in said second direction to disengage said fluid transmission conduit therefrom.

3. The apparatus of claim 1; and said fluid transmission conduit is rotated in said second direction to disengage said fluid transmission conduit therefrom after said valve means has been manipulated from open position to closed position.

4. The apparatus of claim 1 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to manipulate said conduit disengaging means during manipulation of said valve means between open and closed positions and to thereafter disengage said fluid transmission conduit therefrom.

5. The apparatus of claim 1 wherein said valve means comprises valve head and seat means, said valve head being pivotably rotatable on said seat means.

6. The apparatus of claim 5 further comprising camway slot means defined exteriorly on said valve head means, and camway ball means secured to said valve seat means and carriable in said camway slot means to pivot said valve head means.

7. The apparatus of claim 6 further comprising pin means carried within said valve head for rotation of said valve head in response to rotation of said fluid transmission conduit.

8. The apparatus of claim 7 wherein said camway slot means extends on one end to at least the plane of a diameter cut through the center of the valve head at a right angle to said pin means and on the other end to a point whereby a line from said point to the center of the valve head means defines an angle less than about 45° with the axis of said pin means.

9. The apparatus of claim 7 wherein the maximum distance from the center of the camway ball to a plane passing through said pin means and a center line of said valve means is when the valve head means is in open and closed positions.

10. The apparatus of claim 7 wherein the center line of said camway slot means lies in a plane defined by the center line of said pin means and the center line of the valve means when the valve head means is essentially positioned one-half way between the open and closed positions.

11. The apparatus of claim 6 wherein said camway slot means is of a substantially semicircular configuration upon the periphery of said valve head means.

12. The apparatus of claim 5 whereby upon rotation of the fluid transmission conduit a first degree amount defined at the valve means, the valve head pivotally rotates a second degree amount for complete manipulation from one of open and closed position to the other of open and closed position.

13. An apparatus for the selective disengagement of a fluid transmission conduit insertable through a second conduit for communication to a zone within a well bore, and for control of fluid transmission from said zone upon disengagement of said fluid transmission conduit, comprising: sealing means having a flow passageway communicating with the interior of said fluid transmission conduit and for isolating an annular area between said fluid transmission conduit and said second conduit and above said zone; valve means having a flow passageway communicating with said fluid transmission conduit and with the passageway of said sealing means, said valve means being responsive to manipulation of said fluid transmission conduit in a first direction for manipulation of said valve means between open and closed positions to selectively isolate fluid flow through the passageway of said sealing means to said fluid transmission conduit; and conduit disengaging means above said valve means and having a flow passageway communicating with and carriable by said fluid transmission conduit, said conduit disengaging means being responsive to manipulation of said fluid transmission conduit in said direction after manipulation of said valve means to closed position to disengage said fluid transmission conduit, said sealing means being set within said annular area in response to rotation of said fluid transmission conduit in said first direction, and said valve means being manipulatable from open position to closed position in response to rotation of said fluid transmission conduit in a second direction.

14. The apparatus of claim 13; and said fluid transmission conduit is rotated in said second direction to disengage said fluid transmission conduit therefrom.

15. The apparatus of claim 13; and said fluid transmission conduit is rotated in said second direction to disengage said fluid transmission conduit therefrom after said valve means has been manipulated from open position to closed position.

16. The apparatus of claim 13 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to manipulate said conduit disengaging means during manipulation of said valve means between open and closed positions and to thereafter disengage said fluid transmission conduit therefrom.

17. The apparatus of claim 13 wherein said valve means comprises valve head and seat means, said valve head being pivotably rotatable on said seat means.

18. The apparatus of claim 17 further comprising camway slot means defined exteriorly on said valve head means, and camway ball means secured to said valve seat means and carriable in said camway slot means to pivot said valve head means.

19. The apparatus of claim 18 further comprising pin means carried within said valve head for rotation of said valve head in response to manipulation of said fluid transmission conduit.

20. The apparatus of claim 19 wherein said camway slot means extends on one end to at least the plane of a diameter cut through the center of the valve head at a right angle to said pin means and on the other end to a point whereby a line from said point to the center of the valve head means defines an angle less than about 45° with the axis of said pin means.

21. The apparatus of claim 19 wherein the maximum distance from the center of the camway ball to a plane passing through said pin means and a center line of said valve means is when the valve head means is in open and closed positions.

22. The apparatus of claim 19 wherein the center line of said camway slot means lies in a plane defined by the center line of said pin means and the center line of the valve means when the valve head means is essentially positioned one-half way between the open and closed positions.

23. The apparatus of claim 18 wherein said camway slot means is of a substantially semicircular configuration upon the periphery of said valve head means.

24. The apparatus of claim 17 whereby upon manipulation of the fluid transmission conduit a first amount defined at the valve means, the valve head pivotally rotates a second amount for complete manipulation from one of open and closed position to the other of open and closed position.

25. In an apparatus for the selective disengagement of a fluid transmission conduit insertable through a second conduit for communication to a zone within a well bore, and for control of fluid transmission from said zone upon disengagement of said fluid transmission conduit, including sealing means having a flow passageway communicating with the interior of said fluid transmission conduit and for isolating an annular area between said fluid transmission conduit and said second conduit and above said zone, and conduit disengaging means above a valve means and having a flow passageway communicating with and carriable by said fluid transmission conduit, said conduit disengaging means being responsive to rotation of said fluid transmission conduit after manipulation of said valve means to closed position to disengage said fluid transmission conduit, the improvement comprising: valve means having a flow passageway communicating with said fluid transmission conduit and with the flow passageway of said sealing means, said valve means being responsive to rotation of said fluid transmission conduit to manipulate said valve between open and closed positions to selectively isolate fluid flow through the flow passageway of said sealing means to said fluid transmission conduit.

26. The improvement of claim 25 wherein said sealing means is selectively retrievable on said fluid transmission conduit from said well bore.

27. The improvement of claim 25 wherein said sealing means is set within said annular area in response to rotation of said fluid transmission conduit in a first direction, and said valve means is manipulatable from open position to closed position in response to rotation of said fluid transmission conduit in a second direction.

28. The improvement of claim 27; and said fluid transmission conduit is rotated in said second direction to disengage said fluid transmission conduit therefrom.

29. The improvement of claim 27; and said fluid transmission conduit is rotated in said second direction to disengage said fluid transmission conduit therefrom after said valve means has been manipulated from open position to closed position.

30. The improvement of claim 25 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to manipulate said conduit disengaging means during manipulation of said valve means between open and closed positions and to thereafter disengage said fluid transmission conduit therefrom.

31. The improvement of claim 25 wherein said valve means comprises valve head and seat means, said valve head being pivotably rotatable on said valve seat means.

32. The improvement of claim 31 further comprising camway slot means defined exteriorly on said valve head means, and camway ball means secured to said valve seat means and carriable in said camway slot means to pivot said valve head means.

33. The improvement of claim 32 further comprising pin means carried within said valve head for rotation of said valve head in response to manipulation of said fluid transmission conduit.

34. The improvement of claim 33 wherein said camway slot means extends on one end to at least the plane of a diameter cut through the center of the valve head at a right angle to said pin means and on the other end to a point whereby a line from said point to the center of the valve head means defines an angle less than about 45° with the axis of said pin means.

35. The improvement of claim 33 wherein the maximum distance from the center of the camway ball to a plane passing through said pin means and a center line of said valve means is when the valve head means is in open and closed positions.

36. The improvement of claim 33 wherein the center line of said camway slot means lies in a plane defined by the center line of said pin means and the center line of the valve means when the valve head means is essentially positioned one-half way between the open and closed positions.

37. The improvement of claim 32 wherein said camway slot means is of a substantially semicircular configuration upon the periphery of said valve head means.

38. The improvement of claim 31 whereby upon rotation of the fluid transmission conduit a first degree amount defined at the valve means, the valve head pivotally rotates a second degree amount for complete manipulation from one of open and closed position to the other of open and closed position.

39. In an apparatus for the selective disengagement of a fluid transmission conduit insertable through a second conduit for communication to a zone within a well bore, and for control of fluid transmission from said zone upon disengagement of said fluid transmission conduit, including sealing means having a flow passageway communicating with the interior of said fluid transmission conduit and for isolating an annular area between said fluid transmission conduit and said second conduit and above said zone, and valve means having a flow passageway communicating with said fluid transmission conduit and with the flow passageway of said sealing means, said valve means being responsive to isolation of said fluid transmission conduit to manipulate said valve means between open and closed positions to selectively isolate fluid flow through the passageway of said sealing means to said fluid transmission conduit, the improvement comprising: conduit disengaging means above said valve means and having a flow passageway communicating with and carriable by said fluid transmission conduit, said conduit disengaging means being responsive to rotation of said fluid transmission conduit after manipulation of said valve means to closed position to disengage said fluid transmission conduit.

40. Apparatus for the selective disengagement of a fluid transmission conduit insertable through a second conduit for communication to a zone within a well bore, and for control of fluid transmission from said zone upon disengagement of said fluid transmission conduit, comprising: sealing means having a flow passageway communicating with the interior of said fluid transmission conduit and for isolating an annular area between said fluid transmission conduit and said second conduit and above said zone; valve means having a flow passageway communicating with said fluid transmission conduit and with the passageway of said sealing means, said valve means being responsive to manipulation of said fluid transmission conduit to manipulate said valve means between open and closed positions to selectively isolate fluid flow through the passageway of said sealing means to said fluid transmission conduit; and conduit disengaging means above said valve means and having a flow passageway communicating with and carriable by said fluid transmission conduit, said conduit disengaging means being responsive to manipulation of said fluid transmission conduit after manipulation of said valve means to closed position to disengage said fluid transmission conduit, said sealing means being set within said annular area in response to manipulation of said fluid transmission conduit in a first direction, and said valve means being manipulatable from open position to closed position in response to rotation of said fluid transmission conduit in a second direction.

41. The apparatus of claim 40; and said fluid transmission conduit is manipulated in said second direction to disengage said fluid transmission conduit therefrom.

42. The apparatus of claim 40, and said fluid transmission conduit is manipulated in said second direction to disengage said fluid transmission conduit therefrom after said valve means has been manipulated from open position to closed position.

43. The apparatus of claim 40 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to manipulate said conduit disengaging means during manipulation of said valve means between open and closed positions and to thereafter disengage said fluid transmission conduit therefrom.

44. The apparatus of claim 40 wherein said valve means comprises valve head and seat means, said valve head being pivotably rotatable on said seat means, and further comprising camway slot means defined exteriorly on said valve head means, and camway ball means secured to said valve seat means and carriable in said camway slot means to pivot said valve head means.

45. The apparatus of claim 44 further comprising pin means carried within said valve head for rotation of said valve head in response to manipulation of said fluid transmission conduit.

46. The apparatus of claim 45 wherein said camway slot means extends on one end to at least the plane of a diameter cut through the center of the valve head at a right angle to said pin means and on the other end to a point whereby a line from said point to the center of the valve head means defines an angle less than about 45° with the axis of said pin means.

47. The apparatus of claim 45 wherein the maximum distance from the center of the camway ball to a plane passing through said pin means and a center line of said valve means is when the valve head means is in one of open and closed positions.

48. The apparatus of claim 45 wherein the center line of said camway slot means lies in a plane defined by the center line of said pin means and the center line of the valve means when the valve head means is essentially positioned one-half way between the open and closed positions.

49. The apparatus of claim 44 wherein said camway slot means is of a substantially semicircular configuration upon the periphery of said valve head means.

50. The apparatus of claim 44 whereby upon manipulation of the fluid transmission conduit a first amount defined at the valve means, the valve head pivotally rotates a second amount for complete manipulation from one of open and closed position to the other of open and closed position.

* * * * *

REEXAMINATION CERTIFICATE (450th)

United States Patent [19]

McStravick et al.

[11] B1 4,270,606

[45] Certificate Issued Jan. 28, 1986

[54] APPARATUS FOR SELECTIVE DISENGAGEMENT OF A FLUID TRANSMISSION CONDUIT AND FOR CONTROL OF FLUID TRANSMISSION FROM A WELL ZONE

[75] Inventors: David M. McStravick, Houston; William M. Roberts, Deer Park, both of Tex.

[73] Assignee: Baker International Corporation, Orange, Calif.

Reexamination Reqs:st:
No. 90/000,593, Jul. 12, 1984
No. 90/000,692, Dec. 18, 1984

Reexamination Certificate for:

| | |
|---|---|
| Patent No.: | **4,270,606** |
| Issued: | **Jun. 2, 1981** |
| Appl. No.: | **20,306** |
| Filed: | **Mar. 14, 1979** |

[51] Int. Cl.[4] ..... E21B 33/129; E21B 34/12

[52] U.S. Cl. ..... 166/181; 166/124; 166/133; 166/331; 166/373

[58] Field of Search ..... 166/181, 124, 131, 133, 166/330–332, 334, 373

[56] References Cited

U.S. PATENT DOCUMENTS

| | | | |
|---|---|---|---|
| 1,971,514 | 0/1934 | Stone | 166/124 |
| 2,205,748 | 6/1940 | Knox | 166/124 |
| 2,305,062 | 12/1942 | Church et al. | 166/119 |
| 3,152,643 | 10/1965 | Burns | 166/124 |
| 3,189,316 | 6/1965 | Preston, Jr. | 166/332 X |
| 3,332,495 | 7/1967 | Young | 166/331 X |
| 3,347,318 | 0/1967 | Barrington | 166/331 |
| 3,382,927 | 5/1968 | Davis, Jr. | 166/124 |
| 3,386,701 | 6/1968 | Potts | 251/229 |
| 3,398,928 | 0/1968 | Fredd | 251/251 |
| 3,414,061 | 0/1968 | Nutter | 166/334 |
| 3,442,328 | 5/1969 | Nutter | 166/331 X |
| 4,130,166 | 0/1978 | Akkerman et al. | 166/324 |
| 4,210,207 | 0/1980 | McStravick et al. | 166/330 |

OTHER PUBLICATIONS

Composite Catalog of Oilfield Equipment and Services, 1950–p. 2451, 1975–p. 2900.

1976–1977 Composite Catalog of Oil Field Equipment and Supplies, p. 516.

*Primary Examiner*—Stephen J. Novosad

[57] ABSTRACT

An apparatus is provided for the selective disengagement of a fluid transmission conduit which is insertable through a second conduit for communication to a zone within a well bore, and for control of fluid transmission from the zone upon disengagement of the fluid transmission conduit. The apparatus defines a sealing means, usually a packer assembly, which communicates with the interior of the fluid transmission conduit for isolating an annular area between the fluid transmission conduit and the second conduit and above the zone. Valve means carried by the fluid transmission conduit and communicating with the sealing means is manipulatable between open and closed positions for selective isolation of fluid flow through the sealing means to the fluid transmission conduit. Conduit disengaging means are defined above the valve means for communication with and carriage by the fluid transmission conduit, the conduit disengaging means being responsive to manipulation of the fluid transmission conduit after manipulation of the valve means to closed position for disengagement of the fluid transmission conduit.

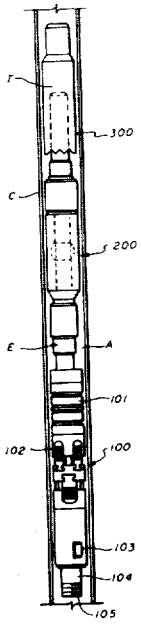

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 40–66:

Referring now to FIG. 1, there is shown within the interior of Casing C (or, the second conduit) a tubing connector 300 carried at the lower end of a fluid transmission conduit T, with a [vlave] *valve* apparatus 200 affixed and carried at the lower end of the tubing connector 300. A tubing extension E at the lower end of the valve apparatus 200 connects to a packer assembly 100 therebelow. The packer assembly 100 comprises a circumferentially extending elastomeric seal assembly 101 of conventional nature at its upper end defining an annulus A between the packer assembly 100 and the casing C. When the packer assembly 100 is set, the seal assembly 101 sealingly engages along the internal diameter of the casing C to prevent fluid migration across the seal assembly 101. The packer assembly 100 also comprises on its outer body a conventional slip assembly 102 for anchoring engagement on the wall of the casing C to prevent upper and lower movement of the packer assembly 100. A conventional guide 103 at the lowermost portion of the packer assembly guides the assembly 100 within the casing C. A packer extension or other tubular means which may have threads 104 for connection to tools or component parts therebelow is defined at the lower end of the packer assembly 100. [Alternatiely] *Alternatively,* the packer extension may simply have defined thereon a port 105 for communication to and ejection of salt water solution, into a zone therebelow.

Column 4, lines 50–64:

Interior of the outer housing 201 is a top sub 213 having the threads 212 defined thereon at its uppermost end and the grooveway 214 defined circumferentially around the exterior of the uppermost end of the top sub 213 for receipt of the inner portion of the arc ring 202. An extension shoulder 215 also is defined on the top sub 213 for transmission of [tensil] *tensile* forces through the apparatus 200. A circumferentially extending elastomeric O-ring seal element 216 is defined circumferentially within a grooveway 217 therefor on the top sub 213 to prevent fluid communication between the top sub 213 and the lower housing 207. Similarly, a ring 218 within a companion groove 219 also is defined on the top sub 213 to prevent fluid communication between the top sub 213 and a ball seat sleeve 222 carried therebelow.

Column 6, lines 15–31:

In FIG. 8, the cage arms 230A and 230B have defined below the hole 229 at the lowermost end thereof an arms sleeve section 230C and 230D, respectively, which is secured within the respective [slips] *slots* 236A defined within the follow sleeve 233, each [slip] *slot* 236A being 180° apart and defined within a cage support ring 236 carried exteriorly of the follow sleeve 233. A cage bearing 235 is carried above the support ring 236 and below an extending outward shoulder 233A on the follow sleeve 233, the cage bearing 235 permitting rotation between the cage arms 230A, 230B and the cage support ring 236, and the follow sleeve 233. The lower end 233B of the follow sleeve 233 has an elastomeric O-ring seal element 238 carried within a circumferentially extending exterior grooveway 239 thereon to prevent fluid communication between the follow sleeve 233 and the lower *portion of* housing 207.

Column 7, lines 31–40:

Now referring to FIG. 16, a slot assembly 307A is defined around the interior of the washover shoe for receipt of a slot pin [310] *302A* defined on the inner mandrel 302. The apparatus is run in the hole and set in a manner known to the art. Then, the conduit T is picked up such that the pin 302A travels from the upper slot 307C through the main carriage 307D to position in the lower slot 307E. Now, the slip assembly 102 is engaged along the inner wall of the casing C and the seal assembly 101 is sealingly engaged on the casing C.

Column 8, lines 7–33:

When it is desired to remove the conduit T from the well bore, the ball 226 of the valve apparatus 200 is first caused to be manipulated from the open to the closed position. First, set down weight is applied through the conduit T, typically on the order of from between about 5,000 to about 10,000 pounds, and the conduit T is rotated to the left. As set down weight is applied through the conduit T, the pin 302A of the tubing connector 300 is caused to be shifted within the slot 307A from the lower slot 307E through the main carriage 307D to the upper slot 307C. Then, the conduit T is rotated to cause a 180° rotation at the valve apparatus 200. Now referring to FIGS. 8 through 14, as the conduit T is rotated to the left, such lefthand rotation is carried through the valve apparatus 200 through the top sub 213 and to the ball seal sleeve 222 interconnected therewith. However, the outer housing 201 will not be caused to rotate because of the free play afforded by the bearings 203 and 204 in conjunction with the positioning of the rotation lock 220 around the slot 213A, *thus providing a rotational lost motion connection between outer housing 201 and inner ball sleeve 222.* The outer housing 201 will not rotate until such time as the arresting stop 213B moves from the stop end 213C to the stop end 213D. It should be noted that the travel distance or lost motion between the end 213C of the rotation lock 220 and the end 213D of the rotation lock 220 is sufficient to permit the arresting stop 213B and the top sub 213, together with the ball seat sleeve 222, to travel 180°.

AS A RESULT OF REEXAMINATION, IT HAS BEEN DETERMINED THAT:

Claims 14, 15, 25–39, 41 and 42 are cancelled.

Claims 1, 3, 13, 16, 24, 40, 43 and 50 are determined to be patentable as amended.

Claims 2, 4–12, 17–23 and 44–49, dependent on an amended claim, are determined to be patentable.

New claims 51–61 are added and determined to be patentable.

1. Apparatus for the selective disengagement of a fluid transmission conduit insertable through a second conduit for communication with a zone within a well bore, and for [control] *interruption* of fluid transmission from said zone upon disengagement of said fluid transmission conduit, comprising: sealing means having a flow passageway communicating with the interior of said fluid transmission conduit and for isolating an annular area between said fluid transmission conduit and said second conduit [and] above said zone; *rotary* valve means *above said sealing means* having a flow passageway communicating with said fluid transmission conduit and with the passageway of said sealing means, said valve means [being responsive to] *comprising a ball rotated by* rotation of said fluid transmission conduit [to manipulate said valve means] between [said] open and closed positions to selectively [isolate] *interrupt* fluid flow through the passageway of said sealing means to said fluid transmission conduit; and conduit disengaging means above said valve means *carriable by said fluid transmission conduit* and having a flow passageway communicating with [and carriable by said fluid transmission conduit] *said flow passageway of said rotary valve means;* said conduit disengaging means being responsive to rotation of said fluid transmission conduit after [manipulation] *rotation* of said valve means to closed position to [disengage] *interrupt fluid flow through* said fluid transmission conduit, said sealing means being set within said annular area [in response to] *by* rotation of said fluid transmission conduit in a first direction, and said valve means being [manipulatable] *rotatable* from open position to closed position in response to rotation of said fluid transmission conduit in a second direction.

3. The apparatus of claim 1; and said fluid transmission conduit is rotated in said second direction to disengage said fluid transmission conduit therefrom after said valve means has been [manipulated] *rotated* from open position to closed position.

13. An apparatus for the selective disengagement of a fluid transmission conduit insertable through a second conduit for communication to a zone within a well bore, and for [control] *interruption* of fluid transmission from said zone upon disengagement of said fluid transmission conduit, comprising: sealing means having a flow passageway communicating with the interior of said fluid transmission conduit and for isolating an annular area between said fluid transmission conduit and said second conduit and above said zone; *rotary* valve means having a flow passageway communicating [with] *between* said fluid transmission conduit and [with] the passageway of said sealing means, *said valve means flow passage area being substantially equal to the flow area of said sealing means flow passageway,* said valve means being [responsive to manipulation] *rotated by rotation* of said fluid transmission conduit in a first direction for [manipulation] *rotation* of said valve means between open and closed positions to selectively [isolate] *interrupt* fluid flow through the passageway of said sealing means to said fluid transmission conduit; and conduit disengaging means above said valve means and having a flow passageway communicating with and carriable by said fluid transmission conduit, said conduit disengaging means *being* responsive to [manipulation] *rotation of said fluid transmission conduit in said first* direction after [manipulation] *rotation* of said valve means to closed position to disengage said fluid transmission conduit, said sealing means being set within said annular area [in response to] *by* rotation of said fluid transmission conduit in *a direction opposite to* said first direction [and valve means being manipulatable from open position to closed position in response to rotation of said fluid transmission conduit in a second direction].

16. The apparatus of claim 13 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to [manipulate said conduit disengaging means during manipulation of] *rotate* said valve means [between] *from* open [and] *to* closed [positions] *position* and to thereafter disengage said fluid transmission conduit therefrom.

24. The apparatus of claim 17 whereby upon [manipulation] *rotation* of the fluid transmission conduit a first amount defined at the valve means, the valve head pivotally rotates a second amount for complete [manipulation] *rotation* from one of open and closed position to the other of open and closed position.

40. Apparatus for selective disengagement of a fluid transmission conduit insertable through a second conduit for communication to a zone within a well bore, and for [control] *interruption* of fluid transmission from said zone upon disengagement of said fluid transmission conduit, comprising: sealing means having a flow passageway communicating with the interior of said fluid transmission conduit and for isolating an annular area between said fluid transmission conduit and said second conduit and above said zone; *rotatable* valve means *above said sealing means* having [a] *an unrestricted* flow passageway communicating with said fluid transmission conduit and with the passageway of said sealing means, said valve means being responsive to [manipulation] *rotation* of said fluid transmission conduit to [manipulate] *rotate* said valve means between open and closed positions to selectively [isolate] *interrupt* fluid flow through the passageway of said sealing means to said fluid transmission conduit; and conduit disengaging means above said valve means and having a flow passageway communicating with and carriable by said fluid transmission conduit, said conduit disengaging means being responsive to *further rotation of said fluid transmission conduit* [manipulation] *after rotation* of said valve means to closed position, to disengage said fluid transmission conduit *from said valve means,* said sealing means being set within said annular area [in response to manipulation] *by rotation* of said fluid transmission conduit in a first direction, and said valve means being [manipulatable] *rotatable* from open position to closed position [in response to] *by* rotation of said fluid transmission conduit in a second direction.

43. The apparatus of claim 40 wherein said conduit disengaging means comprises an inner mandrel carriable within an outer housing, one of the inner mandrel and the outer housing defining a slot configuration thereon, and the other of the inner mandrel and the outer housing defining a protruding pin element for carriage within said slot configuration to [manipulate] *rotate* [said conduit disengaging means during manipulation of said] valve means between open and closed

[positions] *position* and to thereafter disengage said fluid transmission conduit therefrom.

50. The apparatus of claim 44 whereby upon [manipulation] *rotation* of the fluid transmission conduit a first amount defined at the valve means, the valve head pivotally rotates a second amount for complete [manipulation] *rotation* from one of open and closed position to the other of open and closed position.

*51. Apparatus for the selective disengagement of a fluid transmission conduit insertable through a second conduit for communication to a production zone within a well bore, and for control of fluid transmission from said zone upon disengagement of said fluid transmission conduit, comprising: a packer for isolating an annular area between said fluid transmission conduit and said second conduit and above said zone and settable in sealing relationship in the well above the production zone, said packer defining a fluid transmission bore communicating with the production zone; a valve housing connected above said packer and defining a first substantially unrestricted flow passage communicating with said packer bore; conduit connecting means for detachably securing said valve housing to the bottom of the tubing string, thereby establishing a second substantially unrestricted flow passage between the tubing string bore and said first unrestricted flow passage; ball valve means responsive to manipulation of said fluid transmission conduit to manipulate said valve means between open and closed positions and rotatably mounted in said valve housing for selectively opening and closing said first flow passage; means connecting said ball valve means to said conduit connecting means to rotate said ball valve means to its closing position relative to said first flow passage by rotation of said conduit connecting means in one direction; said conduit connecting means including means for disconnecting the tubing string from said valve housing and responsive to manipulation of said fluid transmission conduit after manipulation of said valve means to closed position to disengage said fluid transmission conduit by further rotation of said conduit connecting means in the same direction after closing of said first flow passage.*

*52. The apparatus of claim 51 further comprising means for setting said packer responsive to rotation of the tubing string in the direction opposite to said one direction.*

*53. The apparatus of claim 51 or 52 wherein said connecting means comprises a tubular element having its upper end attachable to the tubing string; the lower end of said tubular element having a downwardly open J-slot in its side wall; and said means directly connecting said rotatable ball valve to said connecting means comprises a sleeve rotatable relative to said valve housing and having a J pin engaging said J-slot in the run-in position of the apparatus.*

*54. The apparatus of claim 51 wherein said valve housing includes an inner sleeve directly connecting said ball valve to said conduit connection means; and outer sleeve connected at its lower end to said packer; and a rotational lost motion connection between said inner and outer sleeves permitting limited rotational movement of said inner sleeve and said ball valve independent of said outer sleeve.*

*55. The apparatus of claim 54 further comprising means for setting said packer by rotational movement of said outer sleeve of said valve housing in response to rotation of said conduit connecting means in a direction opposite to said one direction.*

*56. The apparatus of claim 51 wherein said connecting means comprises an inner mandrel carriable within an outer housing, one of the inner mandrel and the outer housing defining a slot configuration having an open bottom end, and the other of the inner mandrel and the outer housing defining a protruding pin element for movement within said slot configuration to rotate said valve means between said open and closed positions and to thereafter disengage said connecting means from the tubing string.*

*57. The apparatus of claim 51 wherein said connecting means comprises an inner mandrel carriable within an outer housing, one of the inner mandrel and the outer housing being secured to the tubing string and the other of the inner mandrel and the outer housing being operatively connected to said valve means; one of the inner mandrel and the outer housing defining a slot configuration having an open bottom end, and the other of the inner mandrel and the outer housing defining a protruding pin element for movement within said slot configuration to rotate said valve means between said open and closed positions and to thereafter disengage said connecting means from the tubing string.*

*58. The apparatus of claim 51 wherein said packer remains in set position in the well after disconnection of the tubing string from said valve housing.*

*59. The apparatus of claim 40 wherein said sealing means remains in sealing relationship between said fluid transmission conduit and said second conduit after disengagement of said fluid transmission conduit from said valve means.*

*60. The apparatus of claims 11, 13, or 40 wherein said valve means comprises an annular ball seat, a ball having a cylindrical passage seatable on said ball seat; said cylindrical passage having its axis vertical in the open position of said ball and horizontal in the closed position; means corotatable with the transmission conduit for rotating said ball about the conduit axis, and camming means engagable with said ball to concurrently rotate said ball about a second axis to move said ball between said open and closed positions.*

*61. The apparatus of claim 51 wherein said ball valve means comprises an annular ball seat, a ball having a cylindrical passage seatable on said ball seat; said cylindrical passage having its axis vertical in the open position of said ball and horizontal in the closed position; means corotatable with the tubing string for rotating said ball about the tubing string axis, and camming means engagable with said ball to concurrently pivot said ball about a second axis to move said ball between said open and closed positions.*

* * * * *